United States Patent [19]

Friedman

[11] Patent Number: 4,564,015

[45] Date of Patent: Jan. 14, 1986

[54] GARMENT WITH BUILT-IN INTERIOR SUPPORT STRUCTURE

[76] Inventor: Allen Friedman, 429 E. 52nd St., New York, N.Y. 10022

[21] Appl. No.: 592,110

[22] Filed: Mar. 22, 1984

[51] Int. Cl.[4] ..... A41C 3/08

[52] U.S. Cl. ..... 128/455; 2/67

[58] Field of Search ..... 128/455, 67, 454, 431

[56] References Cited

U.S. PATENT DOCUMENTS

| | | | |
|---|---|---|---|
| 1,164,642 | 12/1915 | Guinzburg . | |
| 1,566,267 | 12/1925 | Bee | 128/455 |
| 2,009,620 | 7/1935 | Jackson | 128/454 |
| 2,341,032 | 2/1944 | Freed et al. | 2/74 |
| 3,314,432 | 4/1967 | Erteszek | 128/455 |
| 4,372,320 | 2/1983 | Silber | 128/455 |

FOREIGN PATENT DOCUMENTS 1342315 9/1963 France .

*Primary Examiner*—Doris L. Troutman

*Attorney, Agent, or Firm*—Gottlieb, Rackman and Reisman

[57] ABSTRACT

A ladies' top garment with a sewn-in support element to replace the conventional brassiere. In order to provide sufficient support for women wearing lightweight garments, such as a tank top, the invention provides a separate garment component attached to the upper inner side of the main top, and extending rearwardly past its side seam, ending in a releasably engageable strap element at the back.

5 Claims, 5 Drawing Figures

FIG. 2
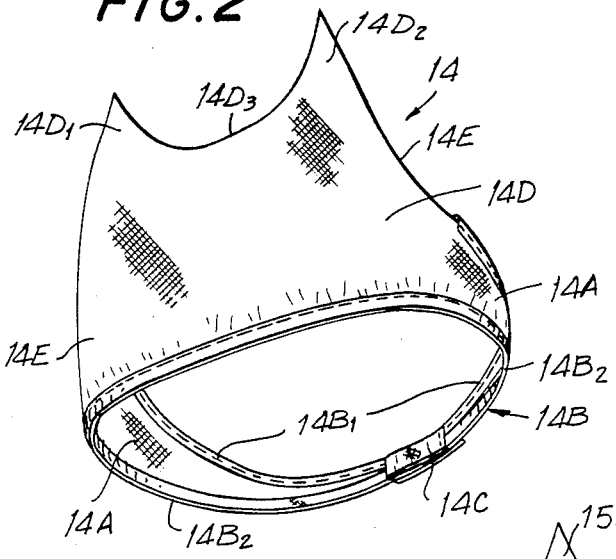
FIG. 1
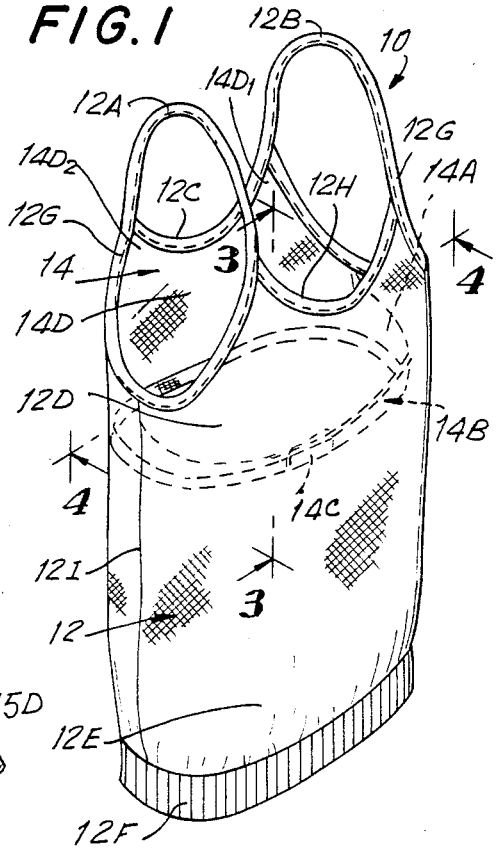
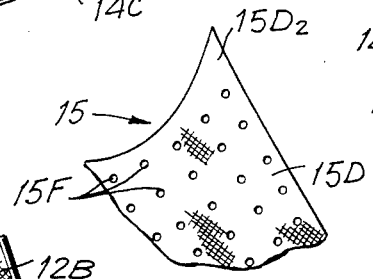
FIG. 2A
FIG. 3
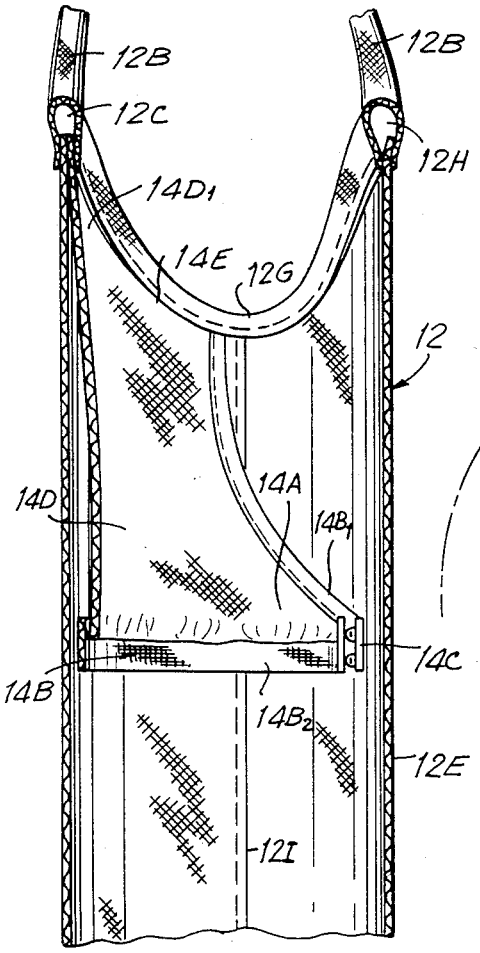
FIG. 4
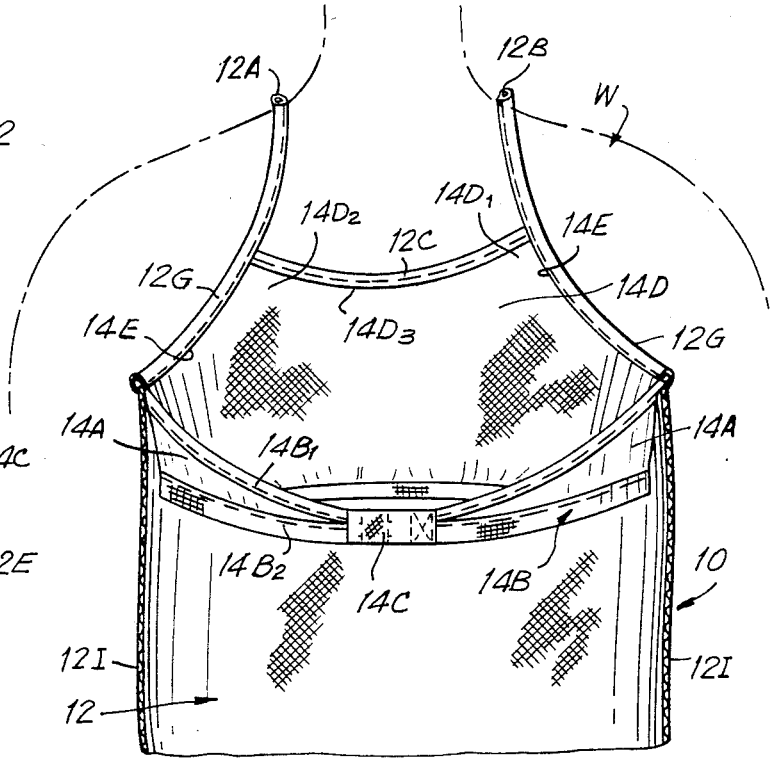

GARMENT WITH BUILT-IN INTERIOR SUPPORT STRUCTURE

DESCRIPTION

This invention relates to leisure time apparel in general, and to ladies' "tops" in particular.

As styles in contemporary clothing have envolved over the past twenty years, a number of trends have emerged. Aside from trying to maintain fashionable looks, emanating from several different design sources and influences, more attention has begun to be paid to integrating comfort with such good looks. This has certainly developed in women's fashions in general, and no where has that trend been more noticeable and popular than in leisure apparel, such as shorts, tops and bathing attire.

With regard to ladies' tops, the need and desire for confort has had to be tempered somewhat in view of the requirements of many women for adequate bust support when wearing such lightweight clothes. Such requirements have often proven to be inconsistent with comfort and ease of movement when loose-fitting tops are being worn.

The prior art has become aware of this problem, but has only partially dealt with it heretofore. For example, some ladies' tops have full built-in brassieres, which does not represent an improvement at all, but merely a predictable combination of two separate apparel items functioning in their normal ways. As women gradually became disenchanted with that arrangement, certain changes in these garments materialized. One such change was the "wired-in" support, which, although constituting less than a complete bra, provided such specific and strong support by means of curved wires, that the same ultimate purpose was achieved. When such "mechanical" structures lost favor, apparel manufacturers realized that only complete fabric support, which could also provide comfort by means of airflow, was feasible—but even here, the current structures do not fully respond to the problem.

In fairly recently developed prior art, such as Silber U.S. Pat. No. 4,372,320, the concept of using an inner supporting garment was arrived at, but has not been wholly satisfactory. Its main failings are that it terminates virtually coincident with the overall garment's side seam, thus ending the side and uplifting support slightly before it extends beyond the end of the women's bustline. This reduces the support which is necessary at a relatively critical location for women requiring such support, thus rendering the overall garment less than satisfactory. Simultaneously, the premature termination of the support element is compounded by having it coupled to only an elasticized strap in the rear of the garment, thus limiting the full range of adjustability which might otherwise be available for the wearer.

It is therefore an object of this invention to obviate one or more of the aforesaid difficulties.

It is a further object of this invention to provide a top garment with increased support for a women's bustline.

It is another object of this invention to extend the side support panels of an inner top garment member to furnish increased uplifting function.

These and other objects and advantages of the invention will become apparent when a particular illustrative embodiment thereof is considered, wherein a ladies' "tank top" is provided with an interior member, affixed in part to the outer garment to furnish front, side and partial rear uplifting support. The inner member is attached to the outer element at the front thereof and along the arc of the upper front bound seam of the garment, generally corresponding to the garment's neckline. The attachment areas continue along the corresponding left and right side boundaries, and significantly, although the attachment region terminates at the vertical side seam, the inner member itself extends past the side seams on both sides of the garment, such seams being located substantially midway between the front and rear portions of the garment.

The inner suspended garment portion is shaped so as to follow the configuration of the bound terminal portions of the main top at the front and sides, and toward the rear of the garment's vertical side seams, a concave portion is provided which extends down and behind the wearer's side, thereby providing side and uplifting support beyond that furnished by the prior art.

The inner attached garment member also is provided with encircling fabric material to be attached by means of a clasp at the rear of the garment, within the outer structure. This provides a controllable closure for the inner garment member and confirms the support function being furnished by the extended side panels of the inner garment member.

It is therefore a feature of an embodiment of this invention that a ladies' top is provided with an inner garment element, including an extended side panel, to enhance the uplifting support for a woman wearing the top.

It is another feature of an embodiment of this invention that a detachable and adjustable rear strap is included to complement the supporting side panel and to improve ancillary adjustability thereof.

Additional objects, features and advantages of this invention will become more readily understood when considered in connection with a presently preferred, but nonetheless illustrative, embodiment of the invention that is explained in the following detailed description and as shown in the accompanying drawing, wherein:

FIG. 1 is an overall perspective view of the apparel top of this invention, equipped with an internal garment providing special supporting functions;

FIG. 2 is a front perspective view of the inner garment member removed from the top for clarity of illustration;

FIG. 2A is a fragmentary perspective view of a portion of the inner garment member, illustrating apertures in one embodiment thereof;

FIG. 3 is a side cross-sectional view of the garment of this invention, taken along the plane 3—3 of FIG. 1 in the direction of the arrows; and FIG. 4 is a rear cross-sectional view of the overall garment, partially cut away to show its use by a wearer, shown in phantom, all taken along the plane 4—4 of FIG. 1 in the direction of the arrows.

In considering the overall embodiment of this invention, a tank top 10 is shown in FIG. 1, with a main torso surrounding portion 12. The top also contains an interior garment member 14 which is attached to the outer garment 10 along several of the terminal borders, to be described below, but remaining free at its bottom portion to encircle the wearer in the upper chest region, around and just beneath the bustline.

The main body portion 12 of top 10 includes a number of component elements which contribute to its normal functioning. Thus, there are left and right support straps 12A and 12B respectively, and front neckline 12C, which generally connects the two straps 12A and 12B. The top is provided with the usual upper rear fabric covering portion 12D and a lower portion 12E which terminates, in this particular illustrative model, with an elasticized band 12F which draws around the wearer's midsection, much as in the fashion of a shirt or jersey. (It will be understood by those skilled in the art that the particular tank top illustrated herein will be worn with shorts, briefs or other diminutive pants by the woman wearing it. Correspondingly, it will be appreciated that the concept of this invention can apply equally well to other tops of varying lengths, as well as to a full one piece bathing suit which will extend further down the woman's body and will not necessitate the wearing of separate pants.)

In the upper portion of the garment 12, additional bound seams are provided along the left and right armholes 12G, and in the rear neckline 12H. Extending downward from the side armholes 12G are left and right vertical side seams 12I, which generally bisect the garment and divide its front from its rear. This side seam region is of some significance, insofar as this is the region where the prior art has seen fit to terminate its inner supporting garments, thereby depriving the wearer of the uplifting support needed from that region and towards the rear. On the other hand, the present invention does not have this failing, since it provides extended support coverage by means of specific components of inner garment element 14, to be described in greater detail below.

Considering the view of FIG. 2 together with that of FIG. 1, the inner garment member 14 is shown in isolated detail. It consists of extended side panels 14A on both sides of the garment, extending in effect past the corresponding region where side means 12I would be opposite the side panel members. The panels are substantially triangular in general shape as they reach toward the rear of the garment at 14B, as illustrated best at the lower left of FIG. 2, and the upper and lower perimeter elements of of the inner garment $14B_1$ and $14B_2$ coverage towards each other, meeting at the apex of a hypothetical triangle which is located where adjustable strap 14C is found.

The main front body portion of inner garment 14 is identified as element 14D. This portion is attached to the main swimsuit body portion at several common seams, including the upper seam $14D_3$ (corresponding to front neckline seam 12C of the top), thereby coupling pointed fabric portions $14D_1$ and $14D_2$ into corner regions at the upper front of the top, as illustrated in FIG. 1. There is also a common attachment area between side panel boundaries 14E of the inner garment element 14 and both side armhole regions 12G of the top.

A consideration of FIGS. 3 and 4 will provide further enlightenment as to the manner in which support is given to the wearer's bustline, taken in the context of the explanations already provided concerning FIGS. 1 and 2. The general sweep of the side panels 14A of inner garment 14 is shown to a large degree in the side cross-sectional view of FIG. 3, with those panels generally "contained" within the gradually converging borders $14B_1$ and $14B_2$ which are also visible in that view. It is noted that these border regions terminate, as does each extended side support panel 14A, at clasp 14C.

The overall support portion 14D of garment 14 is generally located towards the inner front of the tank top and thereby provides normal front and lower support for the woman's bust; but in the important side and rearwardly directed region, it is the panels 14A just pointed out which achieve the important auxiliary uplifting function. The inner garment 14 and particularly its portion 14D ride generally free from front and rear attachment constraints with respect to outer garment 12, although it is of course attached at side seam portion 14E, where it is coupled to armhole portions 12G of the main garment 12.

The manner in which the swimsuit, together with its inner garment member, is worn and utilized by a wearer is generally illustrated, in partially broken away fashion, in the cross-sectional, partially perspective view of FIG. 4. There, the skeletal outline of a wearer W is illustrated, although for purposes of illustration and clarity, the body portions to which the invention applies are not shown. It is indicated to FIG. 4 that as the front portion of the top 12 extends down in front of the wearer's chest, the main panel 14D of the inner garment member 14 is draped in front of the woman's bustline and extends down below the breasts. As the garment moves towards the rear on either side, it progresses towards and past the side seams 12I, and by virtue of supporting side panels 14A, contained within peripheral elements $14B_1$ and $14B_2$, is permitted to surround, encircle, support and then be tied at the rear clasp portion 14C. At the same time, the integrity of the garment is maintained by having the inner garment 14 attached to the main top 12 at upper front border $14D_3$ and along side perimeter elements 14E. In so doing, the inner garment 14 provides a significant addition to the uplifting support which would be lacking if garment member 14 terminated at the side and merely continued just in the form of strap portion 14B, as appears in the prior art.

In the fragmentary view of FIG. 2A, an alternate version of the inner garment member previously discussed is shown. This member is identified as 15, with its corresponding elements being numbered similarly to FIG. 2. Included in the fabric portion 15D are apertures 15F which provided a "breathing" capability to garment member 15. Thus, when the entire composite garment 10 is in actual use, especially in warmer weather, the presence of holes 15F will allow for perspiration and cooling air to pass therethrough, for the wearer's greater comfort.

Accordingly, what this invention has achieved is a significant and finite advance in the art of ladies' garments, and in particular, the provision of important uplifting support for comfort and convenience in ladies' tops to permit women to have fashionable and attractive garments which they wear in leisure situations, without being uncomfortable and being deprived of the necessary bust support and containment which many if not most women find significant.

It is to be understood that the above described embodiments are merely illustrative of the application of the principle of this invention. Numerous variations may be devised by those skilled in the art without departing from the spirit or scope of the invention.

What is claimed is:

1. An article of lightweight women's wearing apparel to furnish support for the bust of the wearer, comprising a main body portion adapted to be worn on the upper torso of the wearer and including a front neckline, a rear neckline, a pair of shoulder portions at the opposite ends of said front and rear necklines, and a pair of armholes under said shoulder portions and having lower arcs, said main body portion being composed of front and rear pieces of sustantially equal areas joined along vertical seams at diametrically opposed sides thereof, an inner garment member located within said main body portion and having a front section adapted to cover and extend below the wearer's bust, a lower section encircling the wearer's torso just below the region of the bust, and a releasably engageable section, including rear adjustment means, defining the lower terminal periphery of said inner garment member, said inner garment member being attached to said main body portion transversely of the same along the length of said front neckline and rearwardly along the lower arc of each of said armholes up to the locations of said vertical seams, respectively, and including a pair of opposed side panels having upper and lower borders and extending rearwardly of the respective vertical seams and terminating at said rear adjustment means to provide side and uplifting support to the bust of the wearer.

2. An article of lightweight women's wearing apparel as defined in claim 1 wherein said main body portion further includes a bottom member having an expandable containment region to provide a snug fit substantially around the wearer's waist region.

3. An article of lightweight women's wearing apparel as defined in claim 1 wherein the upper borders of said side panels extending rearwardly of the associated opposed vertical seams, where the attachment of said inner garment member to said main body portion ends, define a concave arc running from one of said attachment locations to the other past said rear adjustment means.

4. An article of lightweight women's wearing apparel as defined in claim 3, wherein said rear adjustment means includes a clasp for coupling said side panels to each other substantially at the midpoint of said concave arc.

5. An article of lightweight women's wearing apparel as defined in claim 4 wherein said inner garment member comprise a fabric having a plurality of spaced apertures therein to avoid interference with transpiration and the comfort of said wearer.

* * * * *